United States Patent [19]

Kacerek

[11] 3,964,701

[45] June 22, 1976

[54] MODEL RAILROAD TRAIN CONTROL SYSTEM

[76] Inventor: John Kacerek, 97 Ravine Ave., West Caldwell, N.J. 07006

[22] Filed: May 27, 1975

[21] Appl. No.: 580,990

[52] U.S. Cl. ..... 246/2 F; 46/257; 46/262; 104/147 A; 104/152; 246/187 B; 340/171 A

[51] Int. Cl.[2] ..... B61L 3/24

[58] Field of Search..... 104/147 A, 149, 152; 246/2 R, 2 F, 2 S, 182 C, 3, 5, 187 B; 340/171 A; 46/243 LV, 243 P, 244 A, 244 B; 343/225

[56] References Cited

UNITED STATES PATENTS

| | | | |
|---|---|---|---|
| 3,211,111 | 10/1965 | Morley | 104/149 |
| 3,686,447 | 8/1972 | Takalo | 46/244 A X |
| 3,705,387 | 12/1972 | Stern et al. | 340/171 A |

*Primary Examiner*—Trygve M. Blix
*Assistant Examiner*—Stephen G. Kunin
*Attorney, Agent, or Firm*—Kane, Dalsimer, Kane, Sullivan and Kurucz

[57] ABSTRACT

A system is provided to permit the independent, simultaneous operation of several model railroad train sets along a single track at variable speeds and in the forward and reverse direction, as desired. The system employs apparatus for generating a repetitive ultimate duty cycle and for dividing the duty cycle into spaced apart timewise time slots. During each time slot a train driving voltage of preselected polarity and amplitude is applied to the track. Time gaps are provided between the time slots and during each such gap a control signal of predetermined frequency is applied to the track. The system further includes a sensor mounted in each train and connected to the dc motor of the train. Each sensor is tuned to one of the predetermined frequencies and includes a latching circuit responsive to its frequency which latches the dc motor to the track during the immediately following time slot. The duty cycle and time slots are chosen to permit the trains to operate smoothly and without interruption.

4 Claims, 4 Drawing Figures

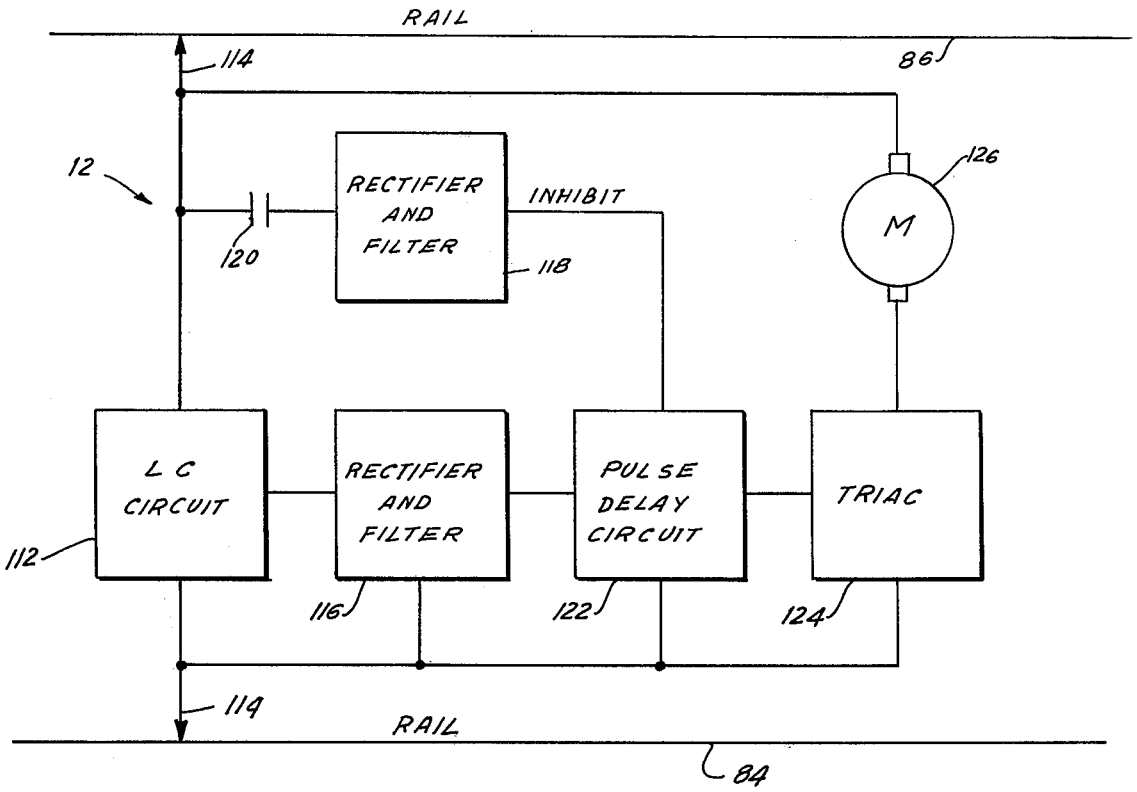
FIG. 2
FIG. 3
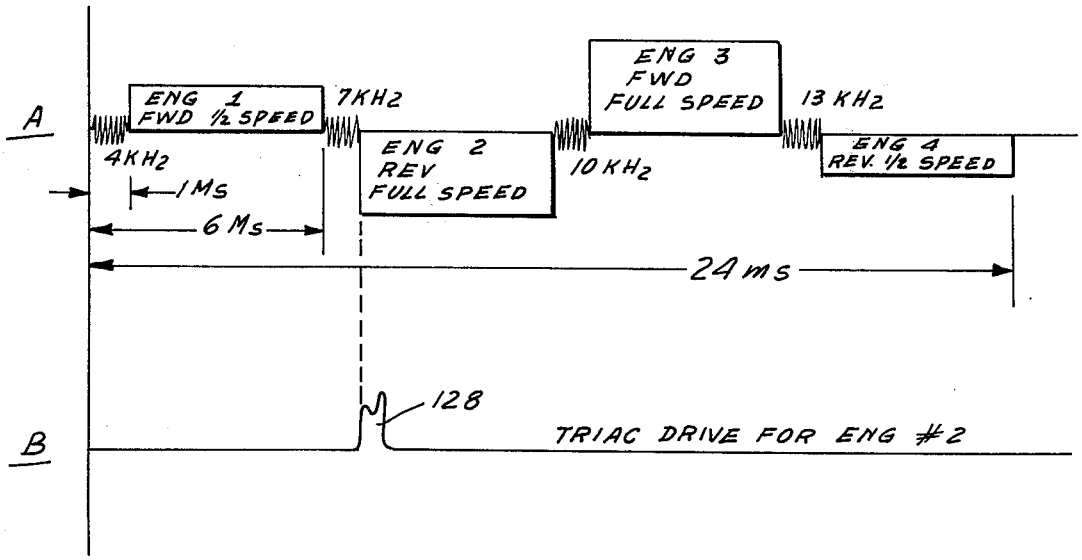

MODEL RAILROAD TRAIN CONTROL SYSTEM

BACKGROUND OF THE INVENTION

The present invention relates to model railroading and more particularly to a system by which a plurality of train sets can be driven along the same set of tracks independently of one another.

In the conventional HO gauge model railroad-electric train setup, the locomotive includes a dc motor which draws power from the track. The speed and direction of the train is governed by the amplitude and polarity of the dc voltage applied to the track. If two or more trains run along the track, heretofore it has been necessary that they operate in tandem, that is, it has not been possible to alter the speed and/or direction of one train without doing precisely the same thing to the other. Obviously, this limits the enjoyment and pleasure one can get from the train setup.

In view of the above, the principal object of the present invention is to provide a system whereby a plurality of electric train motors can be independently driven along the same length of track.

A further object is to provide such a system which can readily be retrofitted into existing layouts at moderate cost.

SUMMARY OF THE INVENTION

The above and other beneficial objects and advantages are attained in accordance with the present invention by providing a system to permit the independent, simultaneous operation of several model railroad train sets along a single track at variable speeds and in the forward and reverse direction, as desired. The system employs means for generating a repetitive ultimate duty cycle and for dividing the duty cycle into spaced apart timewise time slots. During each time slot a train driving voltage of preselected polarity and amplitude is applied to the track. Time gaps are provided between the time slots and during each such gap a control signal of predetermined frequency is applied to the track. The system further includes a sensor mounted in each train and connected to the dc motor of the train. Each sensor is tuned to one of the predetermined frequencies and includes a latching circuit responsive to its frequency which latches the dc motor to the track during the immediately following time slot. The duty cycle and time slots are chosen to permit the trains to operate smoothly and without interruption.

BRIEF DESCRIPTION OF THE DRAWINGS

In the accompanying drawings:

FIG. 2 is a block diagram representation of the sensor mounted in each train set in accordance with the present invention;

FIG. 3 is a plot of signal strength vs. time depicting the ultimate duty cycle, time slots, gaps, control and power signals in accordance with the present invention; and, FIG. 4 depicts waveforms at various parts of the system.

DETAILED DESCRIPTION OF THE PREFERRED EMBODIMENT

Figure 1:
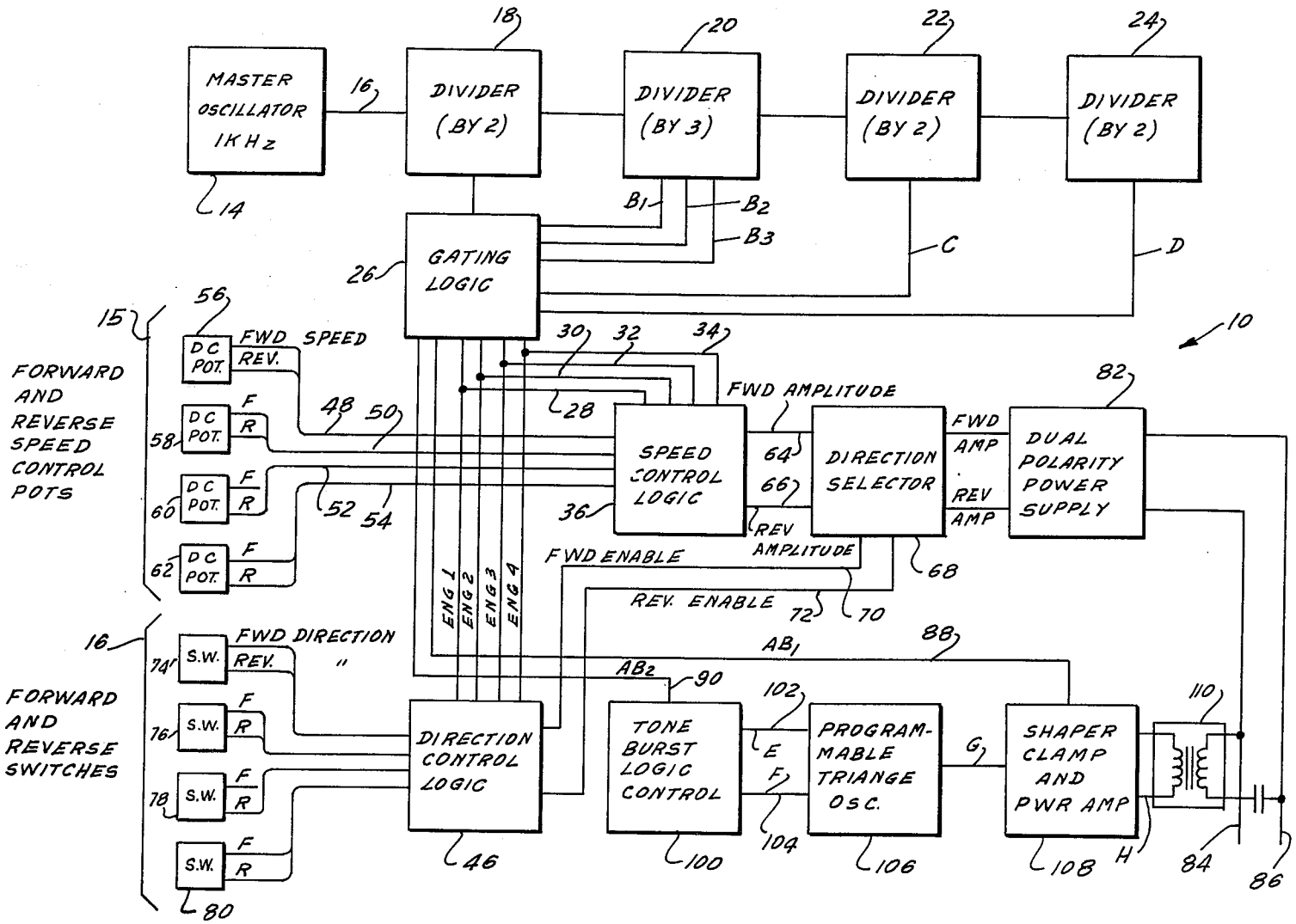
FIG. 1 is a block diagram representation of the master controller utilized in accordance with the present invention to apply power and control signals to the track.

Reference is now made to the drawings wherein a preferred embodiment of the present invention is illustrated. The present system comprises essentially a master controller 10 as depicted in FIG. 1 for the entire layout and a sensor 12 as depicted in FIG. 2 for each model train set of the layout to be controlled. A sensor 12 is connected to the dc motor of each train set in a manner that will be described forthwith. In the following description, a master controller for the control of four train sets will be described as an illustrative example. It should be appreciated from the outset, however, that with minor modification, the present system could readily be modified to control more than four train sets as desired.

Referring to FIG. 1, the master controller 10 comprises a master oscillator 14 which in this preferred embodiment is a 1 kHz oscillator. The output of the oscillator is fed through line 16 to a series of dividers 18, 20, 22 and 24 which respectively divide the output of the oscillator 14 by 2, by 3, by 2 and by 2 to obtain a 24 ms ultimate duty cycle for the full control of four engines. The outputs of the dividers comprise signals A, $B_1$, $B_2$, $B_3$, C and D which are depicted on the first six lines of FIG. 4. These signals are fed to gating logic 26 which generates four spaced apart timewise time slots designated Eng. 1, Eng. 2, Eng. 3 and Eng. 4 and illustrated in FIGS. 3 and 4.

Signals representing the start and finish of the time slots Eng. 1, Eng. 2, Eng. 3 and Eng. 4, are fed through lines 28, 30, 32 and 34 respectively to speed control logic 36 and through lines 38, 40, 42 and 44 respectively to direction control logic 46.

An additional input to the speed control logic 36 comprises four dc voltage levels (from an undepicted source) along lines 48, 50, 52 and 54 the amplitude of each of which is controlled by the setting of one of potentiometers 56, 58, 60 and 62. The function of speed control logic 36 is to correlate the dc voltage levels with the time slots to produce an output signal along lines 64 and 66 during which one of the dc voltage levels appears during time slot Eng. 1, another appears during time slot Eng. 2, etc. The signal amplitudes appearing on lines 64 and 66 during each time slot are identical, however, their polarities are reversed. These signals are fed to direction selector 68 along with the output signals along lines 70 and 72 of direction control logic 46. As stated, one input to the direction control logic 46 comprises the signals indicative of the start and finish of the engine time slots. Whether an output signal appears on line 70 or 72 of the direction control logic during any particular time slot depends on the setting of switches 74, 76, 78 and 80 each of which comprises a single pole, double throw switch. When a particular switch is in a first position, a forward enable signal is generated so that during its associated time slot, the positive value of the voltage level determined by the setting of the associated potentiometer is fed to the track through the power supply. Similarly, when the switch is in its second position, the negative value of the voltage level is applied. The power supply 82 is merely a dual polarity device which converts the dc levels to the necessary track operating voltages.

Thus, the potentiometers 56, 58, 60 and 62; switches 74, 76, 78 and 80; direction control logic 46; speed control 36 and direction selector 68 cooperate so that during each engine time slot a voltage of preselected amplitude and polarity is applied to the tracks the rails of which are generally designated 84 and 86. It is important to note that the amplitude and polarity of the applied voltages during each time slot are totally independent from one another as shown in FIG. 3.

Referring again to both FIGS. 3 and 4, it can be noted that the engine time slots are spaced apart timewise from one another and that the time gap between adjacent time slots comprises waveform $AB_1$, appearing in the seventh line of FIG. 4. The 1,000 Hz master oscillator 14 and dividers 18, 20, 22 and 24 cooperate so that a 1 ms gap appears between each engine time slot which in turn lasts for 5 ms. Signals designating the start and stop of each gap are generated from the gating logic 26 along line 88 for a purpose to be described forthwith.

Figure 4:
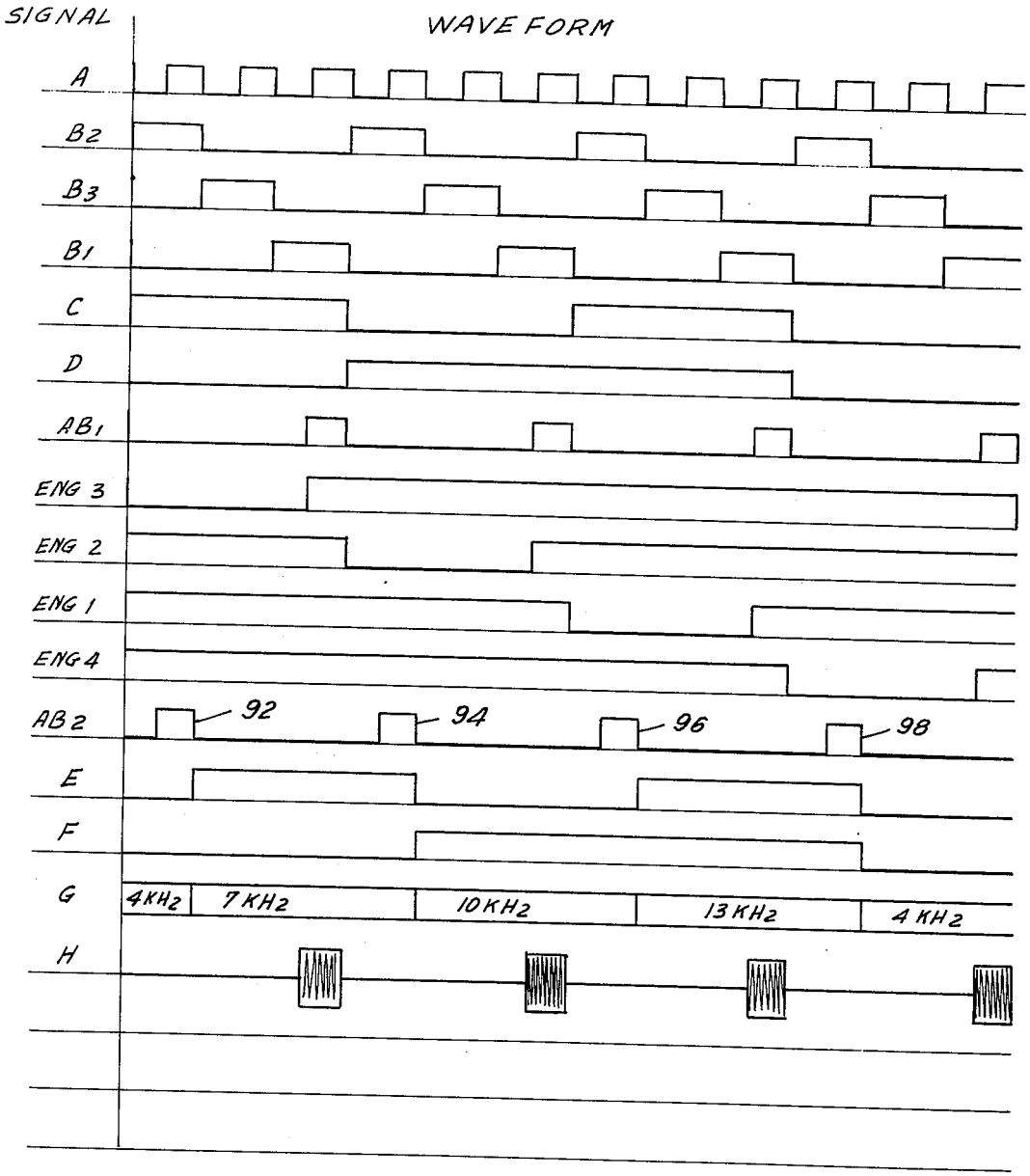

An additional signal $AB_2$ appears as an output of gating logic 26 along line 90. As shown in FIG. 4, the start and stop of each time period generated along line 90 appears during one of the engine time slots. Thus, $AB_2$ waveform 92 appears during the Eng. 3 time slot, $AB_2$ waveform 94 appears during the Eng. 2 time slot, $AB_2$ waveform 96 appears during the Eng. 1 time slot and $AB_2$ waveform 98 appears during the Eng. 4 time slot.

The $AB_2$ signals are fed through line 90 to control signal logic 100. This logic consists merely of a set of flip flops which divides the $AB_2$ signals in half to produce an output on line 102 (line E of FIG. 4) and divides the output on line 102 in half again to produce an output on line 104 (line F of FIG. 4). The signals on lines 102 and 104 are applied in altering combinations to drive a voltage controlled oscillator 106 to produce four distinct frequency signals. In a successful practice of the invention, the chosen frequencies were 4 kHz, 7 kHz, 10 kHz and 13 kHz. These four signals are applied to a shaper clamp and power amplifier 108 along with the $AB_1$ signals which acts as a gate to sequentially produce the chosen frequency signals during the $AB_1$ gaps as shown in both FIG. 3 and line H of FIG. 4. The waveforms of line H of FIG. 4 are applied to the track by transformer 110.

Thus, the master controller produces (1) four spaced apart timewise time slots during which a dc voltage of preselected amplitude and polarity is applied to the track and (2) four time gaps, each positioned in time between adjacent time slots during which a signal of preselected frequency is applied to the track.

As stated, the system of the present invention also utilizes a sensor 12 mounted within each model railroad locomotive to be controlled. The sensor is depicted in FIG. 2 and comprises an LC circuit 112 tuned to one of the preselected frequencies (i.e., 4 kHz, 7 kHz, 10 kHz, or 13 kHz). Each of the other locomotives of the setup would include an identical sensor except that its corresponding LC circuit would be tuned to one of the other frequencies. The LC circuit is shunted across the rails 84 and 86 through the wipers 114 of the locomotive. The output of the LC circuit is fed to rectifier 116 where it is clamped, rectified and filtered to obtain a dc signal whose output is maximum when the master controller 10 is transmitting a signal to the track the frequency of which is that for which the LC circuit is tuned.

The track signal is also fed to a second rectifier 118 through capacitor 120. The output of rectifier 118 comprises a fixed dc output whenever a frequency signal is transmitted to the track (i.e., during each gap). The outputs of rectifiers 118 and 116 are both fed to a pulse delay circuit 122 which blocks transmission of any signal as long as an output signal appears from rectifier 118. The pulse delay circuit output is connected to a triac 124 which, in turn, is connected in series with the motor 126 of the locomotive across the track rails. The triac latches the motor to the track when fired regardless of the polarity of the motor driving voltage.

Thus, during each time gap, the output of rectifier and filter 118 inhibits the output of rectifier 116 from firing the triac through the pulse delay circuit. Immediately, at the end of each gap the output of rectifier 116 stored by its filter capacitor fires the triac which then latches the motor to the dc level generated during the immediately following engine time slot enabling the engine to draw power from the track during that time slot. This is shown in FIG. 3, line B wherein immediately preceding the Engine 2 time slot, the sensor in the number 2 locomotive will generate a triac firing signal 128 to latch the motor associated with that sensor to the "full speed-reverse" signal generated during the Engine 2 time slot.

As stated, more or less than four engines could be operated utilizing the above described system, however, generating more than four time slots would reduce the duty cycle to less than the 20% duty cycle disclosed herein which would result in the engines operating in a jerking fashion and would require higher operating voltages. In a successful experimental practice of the present invention, the 20% duty cycle was found to operate the locomotives smoothly and uniformly without any noticeable degradation in the performance of any one locomotive.

Thus, in accordance with the above, the aforementioned objects are effectively attained.

Having thus described the invention, what is claimed is:

1. A system for simultaneously driving dc motor driven electric trains at speeds and directions independent of each other along a track to which power is fed, said circuit comprising:

means for generating a repetitive ultimate duty cycle;

means connected to said aforementioned means for dividing said duty cycle into a plurality of spaced apart timewise time slots, said time slots being separated from one another by an equal plurality of time gaps;

an equal plurality of variable amplitude and polarity dc voltage sources;

means for interconnecting one of said voltage sources with said track during each of said time slots;

means for generating signals of differing discrete frequencies during each of said time gaps of the ultimate cycle;

a dc motor and a sensor mounted in each of said trains, said sensor including frequency responsive means tuned to one of said discrete frequencies;

a dual polarity latching subcircuit connected in series with said train dc motor across said track; and, latch driving means interconnecting said frequency responsive means and said latching subcircuit to latch said latching subcircuit and motor across said track during the time slot following the gap in which said discrete frequency signal was generated.

2. The system in accordance with claim 1 wherein said means for generating signals of differing discrete frequencies includes a voltage controlled oscillator.

3. The system in accordance with claim 1 wherein said latching subcircuit comprises a triac.

4. The invention in accordance with claim 3 wherein said latching driving circuit includes means for generating a dc pulse during each gap and means for inhibiting said dc pulse from firing said triac until the end of said gap.

* * * * *